US007360656B2

(12) United States Patent
Santos

(10) Patent No.: US 7,360,656 B2
(45) Date of Patent: Apr. 22, 2008

(54) METHOD TO IMPROVE THE CLEANER FROTH FLOTATION PROCESS

(75) Inventor: Daniele Cristina Almeida Hummel Pimenta Santos, Sao Paulo (BR)

(73) Assignee: Rohm and Haas Company, Philadelphia, PA (US)

( * ) Notice: Subject to any disclaimer, the term of this patent is extended or adjusted under 35 U.S.C. 154(b) by 33 days.

(21) Appl. No.: 11/303,522

(22) Filed: Dec. 16, 2005

(65) Prior Publication Data

US 2007/0138065 A1 Jun. 21, 2007

(51) Int. Cl.
*B03D 1/016* (2006.01)
*B03D 1/02* (2006.01)

(52) U.S. Cl. ..... 209/166; 209/167

(58) Field of Classification Search ..... 209/166, 209/167; 252/61
See application file for complete search history.

(56) References Cited

U.S. PATENT DOCUMENTS

| | | | |
|---|---|---|---|
| 2,740,522 | A | 4/1956 | Aimone et al. |
| 3,572,504 | A | 3/1971 | DeCuyper et al. |
| 4,162,044 | A | 7/1979 | Manfroy et al. |
| 5,019,246 | A | 5/1991 | Wang et al. |
| 6,536,595 | B2 | 3/2003 | Kowalski et al. |

FOREIGN PATENT DOCUMENTS

| | | | |
|---|---|---|---|
| AU | 7247200 | * | 4/1974 |
| GB | 2193660 A | | 2/1988 |

* cited by examiner

*Primary Examiner*—Thomas M. Lithgow
(74) *Attorney, Agent, or Firm*—Thomas D. Rogerson

(57) ABSTRACT

The present invention provides a method to improve the cleaner froth flotation process for the selective separation of ore values including, for example, copper, zinc, molybdenum, iron and mixtures there of, in existing flotation plants comprising the step of adding one or more acrylic acid polymers and copolymers to the cleaner froth flotation step in a standard multistep flotation process.

3 Claims, No Drawings

METHOD TO IMPROVE THE CLEANER FROTH FLOTATION PROCESS

The present invention provides a method to improve the cleaner froth flotation process for the selective separation of ore values including, for example, copper, zinc, molybdenum, iron, and mixtures thereof, in existing flotation plants comprising the step of adding one or more monocarboxylic acid polymers and/or copolymers at the cleaner flotation step of the process. Such polymers may be used in combination with conventional anionic collectors such fatty acids, thiocarbamates or xanthates, thiols or mercaptans, dithiophosphates or aerofloats, trithiocarbonates, thioureas, sulfates, sulfurs, oxides, alkali and alkaline earth hydroxides, and low pH range ammoniacal collector bases such as, for example, amines and azepines. The process of the present invention accelerates the flotation kinetics for sulfide ore resulting in increases in average from 6% to 9% of total copper recovery and 2% of copper grade. For some ores molybdenum and iron recoveries and grades are also increased.

Generally, the physical as well as the chemical properties of minerals are used in ore processing, in order to separate them from each other. The flotation method uses differing surface properties. In the flotation process, an ore is wet ground to obtain a pulp. Reagents are added to the pulp to form a suspension called a "slurry", where the surface properties of certain minerals can, in this system, either be activated or deactivated. The success of a flotation process for copper, molybdenum, zinc, and iron depends to a great degree on reagents called collectors that impart selective hydrophilicity to the mineral value which is to be separated from other minerals that may be present in the slurry. In the flotation process the activated mineral particles are attached to air bubbles formed, typically by sparging, in the ore slurry in an apparatus referred to as a flotation cell, they then rise to the surface as a foam, and the foam is skimmed off as concentrate. The concentrate from this initial flotation step, referred to as a rough or rougher flotation, is sent as a pulp to a second flotation cell, referred to as a cleaner flotation cell, and the flotation process is repeated. The cleaner concentrate typically presents a higher grade (e.g. % Cu) concentrate than obtained by rough flotation alone. Material left behind in the flotation cells is referred to as tails, tailings, or gangue. Tails from the cleaner cells are typically reground and recycled to the rough cells for further flotation. In a similar manner, tails from the rougher cells are recycled to flotation cells referred to as scavenger cells for a further flotation. As a result, the flotation process encompasses a number of flotation steps in which a concentrate from one cell is refloated in a second cell and tails are recycled.

For ongoing processing, collector agents, frothing agents, and modifiers are added to the pulp, concentrates, and tails to reactivate or deactivate the mineral surfaces and thus selectively float valuable minerals from undesirable gangue portions of the ore in subsequent flotation steps. These modifiers are also largely responsible for the success of flotation separation of sulfide and other minerals. Modifiers include all reagents whose principle function is neither collection nor frothing, but one of modifying the surface of the mineral so that a collector either adsorbs to it or does not. Modifying agents may thus be considered as depressants, activators, pH regulators, deactivators, or rheology modifiers. Often, a modifier may perform several functions simultaneously.

The effectiveness of all classes of flotation agents depends to a large extent on the degree of alkalinity or acidity of the ore pulp. As a result, modifiers that regulate the pH are of great importance. The most commonly used pH regulators are calcium hydroxide, hydrated lime, calcium peroxide, calcium carbonate, soda ash and, to a lesser extent, caustic soda. In copper sulfide flotation, which dominates the sulfide flotation industry, lime is by far the most extensively used to maintain a pH over 10.5. and as high as 12.0-12.5. This practice imparts high processing costs associated with adding lime as well as deterioration due to scaling on plant and flotation apparatus. One difficulty in flotation processes is a result of very fine particles formed during naturally or during the grinding process, which is referred to as slime. While it is often possible to deslime ores prior to froth flotation, this is not always possible, or desirable, because in many cases certain components of the gangue carry with them recoverable values and in other cases it is often necessary to grind the feed to such a very fine size that practically all feed may be considered as a slime. The addition polymers or salts was recommended to be added at any convenient point in the ore treatment to improve the desliming of the pulp without impact on main floatation results.

The most common copper-bearing ores are made up of sulfides. Chalcopyrite ($CuFeS_2$), is the most common copper sulfide mineral and, as such, contributes to the majority of the world copper production. There are other copper sulfide minerals with significant contribution, such as, for example, bornite ($Cu_2FeS_4$), chalcosite ($Cu_2S$), and covellite ($CuS$). These minerals may appear with other natural contaminants that make up the gangue minerals.

The success of a sulfide flotation process depends upon reagents called collectors that impart selective hydrophobicity to the value sulfide mineral (copper) that has to be separated from other minerals. Conventional sulfide collectors include xanthates (K+ or Na+ salts of ROC(S)SH)), dithiophosphates, thiocarbamates, (RORN(H)C(S)OR), and trithiocarbonates. In general, xanthates and dithiophosphates are employed as sulfide collectors in the froth flotation of base metal sulfide ores. A major problem with such sulfide collectors is that at pH's below 11.0, poor rejection of pyrite or pyrhotite is obtained. Use of modifiers, more particularly depressants, to depress the non-value sulfide minerals and gangue minerals so that they do not float in the presence of collectors, thereby reduces the levels of non-value sulfide contaminants found in the concentrate. Sulfide depressants have generally comprised highly toxic and difficult to handle inorganic compounds such as sodium cyanide, (NaCN), sodium hydro sulfide, (NaSH), and Nokes reagent ($P_2S_5$ and NaOH). They cannot be used safely over a wide range of pH values, but instead must be used at high pH values, so that lime consumption problems are not solved by their use. In addition, in the case of high contaminated ores the gangue minerals present a unique problem in that they exhibit natural floatability, i.e. they float independent of the value mineral collectors used. Such gangue minerals are often siliceous, calcareous or dolomitic. Even if very selective value mineral collectors, such as, for example, low pH range collectors based on amine or azepine use in combination with current collectors and acrylic polymers in the first stages of ore treatment, are used for oxidized ores when the gangues are siliceous, calcareous or dolomite, non value minerals the gangue are still not sufficiently differentiated.

U.S. Pat. No. 4,162,044 discloses the benefits achieved through incorporation of acrylic polymers into the grinding operation for processing of coal or mineral ores and were described as increase in particle breakage and production of higher density (solids) slurries, leading to a greater throughput of the refined ore in flotation processes. In other cases, similar polymers have been introduced into prior conditioning stages or flotation circuits; see, for example, U.S. Pat. No. 2,740,522.

Unexpectedly, in view of the foregoing, I have discovered that certain synthetic polymers and copolymers which contain specific functional groups are very effective depressants for sulfide minerals in general, and, more particularly, for pyrite, pyrrhotite, and other gangue sulfide minerals when added to the flotation process at the cleaner flotation stage. Such polymers and copolymers overcome the low efficiency of conventional collectors in the cases above and increase the throughput to improve the mineral recovery and grade Polymers useful in the practice of the method of this invention are homopolymers or copolymers which comprise from 40 to 100 mol percent polymerized units of one or more monoethylenically unsaturated $C_3$ to $C_6$ monocarboxylic acids, from 0 to 60 mol percent polymerized units of one or more monoethylenically unsaturated $C_4$ to $C_6$ dicarboxylic acids, and from 0 to 40 mol percent polymerized units of one or more lower-alkyl esters of the one or more mono- or dicarboxylic acids, or mixtures thereof. In one embodiment of this invention, the polymers have a molecular weight of from 2000 to 1200,000 Daltons. In one embodiment of this invention, the monocarboxylic acid unit is acrylic acid, methacrylic acid, or a mixture thereof.

My invention is, therefore, a process to improve the recovery of mineral values from a cleaner froth flotation process comprising the step of incorporating one or more homopolymers, copolymers, or mixtures thereof into the cleaner flotation pulp prior to or during the cleaner flotation process, wherein each of the homopolymer, copolymer, and mixture thereof independently comprise from 40 to 100 mol percent polymerized units of one or more monoethylenically unsaturated $C_3$ to $C_6$ monocarboxylic acids, from 0 to 60 mol percent polymerized units of one or more monoethylenically unsaturated $C_4$ to $C_6$ dicarboxylic acids, and from 0 to 40 mol percent polymerized units of one or more lower-alkyl esters of the one or more mono- or dicarboxylic acids, and mixtures thereof.

The term "copolymer" as used herein refers to a polymer of two or more monomers. The term "polymerized units" as used herein refers to units which may occur in the polymer chain as the result of polymerizing the monoethylenically unsaturated mono- or dicarboxylic acids, however one skilled in the art will recognize that identical units may occur in the polymer chain as the result of polymerizing the corresponding anhydride, and therefore the term refers to polymers containing units derived from polymerizing either the monoethylenically unsaturated mono- or dicarboxylic acid, or the corresponding anhydride.

The term "lower alkyl" as used herein refers to a linear or branched alkyl group containing from one to eight carbon atoms. The terms "(meth)acrylate" and "(meth)acrylic" as used herein mean acrylate, methacrylate or both acrylate and methacrylate; and acrylic, methacrylic or both acrylic and methacrylic. The term "unsubstituted" as used herein with respect to the lower alkyl group means that the lower alkyl group is not substituted with a functional group such as a hydroxyl group; it does not exclude the presence of a hydrocarbon branch.

In one embodiment of this invention the monoethylenically unsaturated $C_3$ to $C_6$ monocarboxylic acid is one or more of acrylic acid, methacrylic acid, vinyl acetic acid, crotonic acid, and acryloxypropionic acid. In another embodiment of this invention the monoethylenically unsaturated $C_4$ to $C_6$ dicarboxylic acids is one or more of maleic acid, itaconic acid, mesaconic acid, fumaric acid, citraconic acid, and the anydrides of cis dicarboxylic acids, such as maleic anhydride.

In one embodiment of this invention, the range for the polymerized units of one or more monoethylenically unsaturated $C_4$ to $C_6$ dicarboxylic acids is from 5 to 50 mol percent, and in another embodiment from 15 to 35 mol percent. In one embodiment of this invention the range for the polymerized units of one or more lower-alkyl esters of (meth)acrylic acid is from 10 to 30 mol percent, in another embodiment from 15 to 25 mol percent. The combined dicarboxylic acid units and units of alkyl esters of (meth) acrylic acid total at most 60 mol percent of the polymer, as the minimum amount of monoethylenically unsaturated $C_3$ to $C_6$ monocarboxylic acids is 40 mol percent.

The alcohol component of the lower-alkyl ester of (meth) acrylic acid is preferably methanol, ethanol, propanol or butanol, and may be linear or branched, and further may be a diol, such as ethanediol, 1,2-propanediol, 1,3-propanediol, 1,2-butanediol, 1,3-butanediol and 1,4-butanediol, resulting in an ester substituted with a single hydroxyl group on the alcohol component. The unsubstituted lower-alkyl ester of (meth)acrylic acid is more preferably selected from the group consisting of methyl acrylate, ethyl acrylate, n-propyl acrylate, sec-propyl acrylate, n-butyl acrylate, iso-butyl acrylate, 1-methylpropyl acrylate and 2-methylpropyl acrylate, and the corresponding methacrylates, and is still more preferably selected from the group consisting of methyl acrylate, methyl methacrylate, ethyl acrylate and ethyl methacrylate. Examples of the lower-alkyl ester of (meth)acrylic acid substituted with a hydroxyl group, which are useful in the present invention, are hydroxyethyl acrylate and methacrylate, hydroxypropyl acrylate and methacrylate and hydroxybutyl acrylate and methacrylate.

The polymeric compositions of the present invention may be made by aqueous polymerization, solvent polymerization or bulk polymerization. Further, the polymerization may be conducted as a batch, co-feed, heel, semi-continuous or continuous process. Preferably the polymerization is conducted as a co-feed process. When the process of the present invention is conducted as a co-feed process, the initiator and monomers are preferably introduced into the reaction mixture as separate streams and at a constant rate. If desired, the streams may be introduced so that addition of one or more of the streams is completed before the others. If desired, a portion of the monomers or initiator may be added to the reactor before the feeds are begun. The monomers may be fed into the reaction mixture as individual streams or combined into one or more streams. Typical processes for the preparation of the polymers are disclosed in U.S. Pat. Nos. 5,077,361, 5,244,988, 4,314,044, 4,301,266, 4,704,303, the disclosures of which are incorporated by reference herein.

The molecular weight, as determined by gel permeation chromatography by comparison with standards of known molecular weight, of the polymeric additive composition is from 1,000 to 120,000 Daltons. The molecular weight will vary depending upon the relative amounts, and the hydrophilicity, of the monomer components incorporated into the copolymer. If desired, chain regulators or chain-transfer agents may be employed during the polymerization to assist in controlling the molecular weight of the resulting polymers. Any conventional water-soluble chain regulators or chain-transfer agents may be used such as, for example, mercaptans such as 2-mercaptoethanol and 3-mercaptopropionic acid, hypophosphites, isoascorbic acid, alcohols, aldehydes, hydrosulfites and bisulfites. Preferred as chain regulators or chain-transfer agents are bisulfites such as sodium metabisulfite. End groups of the polymers utilized in the process of this invention are determined by the initiator and/or chain transfer agent utilized in the preparation of the polymer as well as the process used to prepare the polymers. In another embodiment of this invention, the molecular weight is from 2,000 to 70,000 Daltons. In a third embodiment of this invention, the molecular weight is from 5,000 to 60,000 Daltons.

I have also discovered a method to incorporate in the cleaner flotation pulps the polymers and copolymers. The effect of such incorporation is to optimize the segregation of the minerals from the gangue by a one or more of the following mechanisms: a) changing the surface chemical characteristics of the mineral particles in the slurry to improve the electrostatic repulsive forces between the particles sufficient to prevent aggregation decreasing the pulp yield, preventing the sedimentation of the solids in the cells, and avoiding scaling, b) promoting control of air bubble size and number to increase their contact surface and speed up the flotation kinetics, and/or c) removing the majority of the lime species from the surfaces of the metal sulfide particles. Once the insoluble lime species have been removed, the underlying mineral surfaces are exposed to collector and or depressants action.

A wide variety of conventional collectors are useful in combination with the polymers and copolymers of this invention including, for example, fatty acids, thiocarbamates or xanthates, thiols or mercaptans, dithiophosphates or aerofloats, trithiocarbonates, thioureas, sulfates, sulfurs, oxides and hydroxides of sodium and other alkali and alkaline earth metals, other inorganic compounds, and low pH range ammoniacal collector based amines or azepines, and or mixture thereof. Hydrocarbon oils and frothers such as, for example, pine oil, cresylic acids, higher alcohols, and other frothing, agents may also be used.

However, I have discovered that the cleaner flotation is the best dosage point in the flotation circuit, particularly with adequate conditioning timing, and optimizing the dosage of the polymers or copolymers. For operating at 30% standard solids level in the slurry a dosage of 100 g/ton to 300 g/ton of polymer or copolymer into a cleaner flotation cells is preferred. Typically, the flotation kinetics stabilize in the first three minutes of addition of the polymer or copolymer. The pH of the pulp should be slightly adjusted in flotation process for recovery and concentration; not affecting value mineral recovery level given by the use of existing collectors.

EXAMPLES

Laboratory rougher and/or cleaner flotation tests were conducted on copper/molybdenum ore flotation feed slurries obtained from mines in Chile. Conventional combinations of xanthates and dithiocarbamates and/or amoniacal collectors (such amines, azepines, etc), were utilized in the processes. The following polymers were evaluated:

Polymer 1—70/30 acrylic/maleic acid copolymer, fully neutralized Molecular weight about 60,000 Daltons Polymer 2—acrylic acid homopolymer, fully neutralized Molecular weight about 8,000 Daltons Unless otherwise specified, all percentages are percent by weight. The term "g" means grams and the term "ton" means metric ton.

Example 1

A copper ore (1.1% grade) containing chalcopyrite, calcocite, covellite, boetite and siliceous gangue minerals was wet ground to 22% minus 65 mesh resulting in a 67% solids pulp. The pulp was conditioned at a rate equivalent to 14 g/ton of dithiophosphate, 15 g/ton xanthate, and 40 g/ton of a conventional foamer. The pH was adjusted to 11.5 with lime. The pulp was floated in a laboratory flotation cell to remove a copper concentrate. Then, various dosages from 50 g/ton to 400 g/ton of Polymer 1 were added during further grinding of the concentrate and cleaner flotation cells operating with 23% and 30% solids pulps. After that the effect on sedimentation stage evaluated. For 200 g/ton of Polymer 1, the results indicate no major effect was produce on grinding for higher solids pulps 71.7% or 76.7%, the particle size distributor was similar to the control grinding pulp standard at 67% solids. No significant increase of copper recovery or grade were obtained by adding the copolymer into the initial grinding stages. An average of 3.5% increase in copper recovery was obtain when using 200 g/ton of Polymer 1 into a rougher flotation operated at 40% solids, after 1 minute of copolymer conditioning time. An increase to 50% pulp solids resulted in an increase of about 0.5% copper recovery.

The best results were obtained by addition of Polymer 1 into cleaner flotation cells where with dosages from 100 g/ton to 300 g/ton reflected a significant increase of the copper recovery. The highest final concentrate was produced from addition of 300 g/ton into a cleaner flotation which contained 88.84% of copper recovery, 6% higher than obtained in control test in which the copolymer was omitted, 82.24%. Improvement of 2% copper grade concentrate were also obtain for 200 g/ton added into clean flotation with 23% solids pulp. An increase to 30% solids pulp did not improve the copper recovery or grade. The kinetic of flotation is improved around three minutes of conditioning time.

Further benefits were observed with the addition of Polymer 1 including increases in the sedimentation capacity, no damage to the flocculates, and accelerated filtration rate. The scavenger recovery of insoluble copper from the gangue decreased from 0.42% in the control to 0.22% with Polymer 1 dosage.

Example 2

Example 1 was repeated with a 1.2% copper ore containing chalcopyrite, and high contamination gangue composed of siliceous minerals. The ore was ground at 67% pulp solids to 20% minus 65 mesh and conditioned with the equivalent of 14 g/ton of dithiophosphate and 15 g/ton xanthate and 40 g/ton of conventional foamer, and the pH was adjust to 11.5 with lime. The pulp was floated to remove a copper concentrate. In this case both Polymers 1 and 2 were evaluated.

A series of tests were conducted using a fixed polymer dosage distributed into different floatation stages to evaluate the best dosage point as follows: a) 200 g/ton was added to first grinding, b) 100 g/ton was added to the first grinding and 100 g/ton at rough flotation, and, finally, 200 g/ton was added to cleaner flotation. In all, 30%, 40%, and 45%% solids pulps were floated. Additional tests were conducted with 50 g/ton and 100 g/ton. The results confirmed that the more effective copper recovery and grade increase occurs when total polymer dosages of 200 g/ton are added directly into the cleaner flotation. In general, Polymer 2 surpassed the performance of Polymer 1. In general, the 30% solids pulps in the presence of either polymer provided better flotation results than higher % solids pulp. For 40% or 45% solids pulp selectivity of process apparently was harmed by higher viscosities of pulp that inhibited the foam dispersion. The highest final concentrate was produced from addition of 200 g/ton into a cleaner flotation which delivered 82.17% of copper recovery, 9% higher than control test in which the copolymer was omitted, 73.02%. In both cases the same 12% copper grade concentrate was produced. Molybdenium recovery and iron depress were also increase about 5% and 6% from control test. The grades were similar for both minerals also. Further benefits similar to those of Example 1 were observed.

Example 3

A copper ore (1.2% grade) obtained from a mine in Chile containing chalcopyrite, chalcocite, covellite, and gangue minerals was ground to minus 65 mesh. The pulp was conditioned with 6 g/ton of dithiophosphate, 24 g/ton xanthate, and 28 g/ton of conventional foamer. The pH was adjust 10.5. The pulp was floated to remove a copper concentrate. The addition of 200 g/ton of Polymer 1 to rougher flotation allowed an increase of solids pulp from 36% to 50% without harm to the flotation dynamic and delivered additional 2% copper and 2% molybdenium recovery in the resulting concentrate. The rheology of pulps was improved as well as the flotation kinetics are also improved around 3 minutes of conditioning.

Example 4

A low grade copper ore (less than 1.0%) containing chacopyrite, calcocite, covellite, and gangue minerals was ground to 30% minus 65 mesh. The resulting 68% pulp was conditioned with 8 g/ton of dithiophosphate, 25 g/ton xanthate, and 20 g/ton of conventional foamer. The pH was adjusted to 10.8. The pulp was floated to remove a copper concentrate.

Different dosages of 100 g/ton, 200 g/ton, and 300 g/ton of Polymer 1 were added to the grinding mill resulting in pulps at 34% and 50% solids. The pulps were then floated in a cleaner floatation. The results confirmed that the copper recovery is higher with higher solids as in Example 3. In this Example the best recovery was obtained with 100 g/ton at high solids pulp of 50%, where the copper or molybdenium recoveries were less than 2% for the same mineral grades. The weak flotation results confirms that the grinding mill was not the best point of polymer addition.

Other results observed in this Example included: a) improved copper grade from 2% to 5% and 2% to 5% in molybdenium grade in the concentrates, b) improvement of 6% to 10% in copper recovery and 5% in molybdenum recovery, c) depressed iron recovery, and d) faster cleaner flotation kinetics.

The improvements of the grade of copper or molybdenum and/or with improved recovery percentage obtained from the method of this invention will have a high savings impact in the economics of the value mineral flotation cost.

It is also an advantage of the present invention that it is applicable to gangue slimes of the most varied types of ores such as siliceous gangue present in metallic or sulfide ores, for example, lead, zinc, copper, pyrite, lead-zinc ores, precious metal ores, etc. It is also applicable to the various gangues present in non-metallic ores such as, for example, those of tungsten, manganese, barite, fluorspar, limestone and phosphate rock talcs, micas, clays, sericites, limonites, fine carbon and fine calcite are examples of gangues which interfere with flotation especially when these are present as slimes, and other minerals when in the form of slimes frequently are harmful.

I claim:

1. A process to improve the recovery of mineral values from a cleaner froth flotation process comprising the step of incorporating one or more copolymers into the cleaner flotation pulp prior to or during the cleaner flotation process, wherein each of the copolymers comprises from 40 to 95 mol percent polymerized units of acrylic acid, from 5 to 50 mol percent polymerized units of maleic acid, and from 0 to 40 mol percent polymerized units of one or more lower-alkyl esters of the one or more mono- or dicarboxylic acids, and mixtures thereof.

2. The process of claim 1 wherein the molecular weight of each of the one or more copolymers is independently from 2000 to 120,000 Daltons.

3. The process of claim 1 wherein the one or more copolymers are added to the cleaner flotation at a dosage of from 100 grams per ton to 300 grains per ton of pulp.

* * * * *

UNITED STATES PATENT AND TRADEMARK OFFICE

CERTIFICATE OF CORRECTION

PATENT NO. : 7,360,656 B2
APPLICATION NO. : 11/303522
DATED : April 22, 2008
INVENTOR(S) : Daniele Cristina Almeida Hummel Pimenta Santos It is certified that error appears in the above-identified patent and that said Letters Patent is hereby corrected as shown below:

Column 8

Claim 3, Line 42, “grains” should read -- grams --.

Signed and Sealed this

Fifth Day of August, 2008

JON W. DUDAS
*Director of the United States Patent and Trademark Office*